US009849708B1

(12) United States Patent
Ernst et al.

(10) Patent No.: US 9,849,708 B1
(45) Date of Patent: Dec. 26, 2017

(54) MICROWAVE DRYER OF A PRINT SYSTEM WITH MODULATION OF THE MICROWAVE SOURCE USING FREQUENCY SHIFT KEYING

(71) Applicants: Larry M Ernst, Longmont, CO (US); Andrew David Norte, Westminster, CO (US)

(72) Inventors: Larry M Ernst, Longmont, CO (US); Andrew David Norte, Westminster, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/440,377

(22) Filed: Feb. 23, 2017

(51) Int. Cl.

| | |
|---|---|
| ***H05B 6/78*** | (2006.01) |
| ***H05B 6/70*** | (2006.01) |
| ***H05B 6/64*** | (2006.01) |
| ***B41J 11/00*** | (2006.01) |
| ***B41M 7/00*** | (2006.01) |
| ***F26B 3/347*** | (2006.01) |

(52) U.S. Cl.
CPC ..... *B41M 7/0081* (2013.01); *B41J 11/002* (2013.01); *F26B 3/347* (2013.01); *H05B 6/6447* (2013.01); *H05B 6/705* (2013.01); *H05B 6/707* (2013.01); *H05B 6/78* (2013.01)

(58) Field of Classification Search
CPC ..... H05B 6/78
See application file for complete search history.

(56) References Cited

U.S. PATENT DOCUMENTS

| | | | |
|---|---|---|---|
| 3,461,401 | A | 8/1969 | Williams |
| 5,631,685 | A | 5/1997 | Gooray et al. |
| 5,961,871 | A | 10/1999 | Bible et al. |
| 6,259,077 | B1 | 7/2001 | Drozd et al. |

(Continued)

FOREIGN PATENT DOCUMENTS

GB 668835 A * 3/1952 ..... H05B 6/788

OTHER PUBLICATIONS

Rederick W. Ahrens; Application of a Device for Uniform Web Drying and Preheating Using Microwave Energy; Final Report; Sep. 2003.

(Continued)

*Primary Examiner* — Shelby Fidler
(74) *Attorney, Agent, or Firm* — Duft Bornsen & Fettig LLP

(57) ABSTRACT

Microwave dryer of a print system with modulation of the microwave source using FSK. In one embodiment, a microwave dryer includes a microwave source coupled with a waveguide. The waveguide transports electromagnetic energy to dry wet colorant applied by a printer to print media. The microwave source provides the electromagnetic energy at an operating frequency. The microwave dryer also includes a processor coupled with an FSK modulator that modulates the operating frequency of the microwave source. The processor determines a modulating signal with a modulating frequency based on a period of time for the print media to traverse the waveguide, and applies binary values that represent the number of frequencies to an input of the FSK modulator to cause the FSK modulator to output the series of discrete frequencies over the period of time to vary intensity positions of the electromagnetic energy across the width of the print media.

20 Claims, 10 Drawing Sheets

(56) References Cited

U.S. PATENT DOCUMENTS

| | | | | |
|---|---|---|---|---|
| 6,901,683 | B2 | 6/2005 | Lyle et al. | |
| 6,965,099 | B1 | 11/2005 | Habeger et al. | |
| 7,208,710 | B2 | 4/2007 | Gregoire et al. | |
| 9,186,915 | B2 | 11/2015 | Hasebe et al. | |
| 9,327,524 | B1 | 5/2016 | Yamada et al. | |
| 2003/0132227 | A1* | 7/2003 | Geisler | B07C 1/00 219/700 |
| 2003/0154620 | A1* | 8/2003 | Lyle | B41J 11/002 34/245 |
| 2006/0081624 | A1* | 4/2006 | Takada | H01J 37/32192 219/716 |
| 2009/0302031 | A1 | 12/2009 | Mallah | |
| 2011/0115864 | A1 | 5/2011 | Rohde et al. | |
| 2016/0050722 | A1 | 2/2016 | Fu et al. | |

OTHER PUBLICATIONS

Imran Tahir et al.; Frequency and Phase Modulation Performance of an Injection-Locked CW Magnetron; IEEE Transactions on Electron Devices, vol. 53, No. 7, Jul. 2006.

International microwave Power Institute; 48th Annual Microwave Power Symposium; 2014 Proceedings.

L. Hansson et al; Design and performance of an industrial microwave drier for on-line drying of wood components; Abstract.

* cited by examiner

MICROWAVE DRYER OF A PRINT SYSTEM WITH MODULATION OF THE MICROWAVE SOURCE USING FREQUENCY SHIFT KEYING

FIELD OF THE INVENTION

The invention relates to the field of printing systems, and in particular, to microwave dryers of printing systems.

BACKGROUND

Production printing systems for high-volume printing typically utilize a production printer that marks a continuous-form print medium (e.g., a web of paper) with a wet colorant (e.g., an aqueous ink). After marking the print medium, a dryer downstream from the production printer is used to dry the colorant. One such dryer is a microwave dryer that uses microwave energy to heat the colorant to cause a liquid portion of the colorant to evaporate, thereby fixing the colorant to the print medium. The primary mechanism of heating the colorant is dielectric heating.

In a typical microwave dryer, a microwave source directs the microwave energy down a long axis of a waveguide which spans across the width of the print medium. The print medium travels through a short axis of the waveguide via a passageway through the waveguide. As the continuous-form print medium traverses the short axis of the waveguide, the wet colorants applied to the continuous-form print medium are exposed to the microwave energy and dried.

One problem with such microwave dryers is that the microwaves emitted by the microwave source are standing waves inside the cavity of the waveguide. That is, the electromagnetic field along the long axis of the waveguide oscillates in intensity with high power density at peaks of the wave and low power density between the peaks of the wave. Variation of the field intensity across the width of the web leads to heating variations across the width of the web and non-uniform drying of the print media.

SUMMARY

Embodiments herein describe a microwave dryer of a print system with modulation of the microwave source with using frequency shift keying (FSK). A microwave dryer is enhanced to control an output of an FSK modulator to a microwave source. The output of the FSK modulator modifies the fixed frequency value of the microwave source (e.g., 2.45 GHz) such that the microwave source instead oscillates above and below its normally fixed frequency. Changes to the operating frequency of the microwave source results in a more uniform distribution of intensity/heat across the width of a print media traveling through the microwave dryer. Implementation of FSK, which is a digital form of frequency modulation, enables the microwave dryer to adapt to a large range of drying requirements.

One embodiment is a microwave dryer that includes a waveguide configured to transport electromagnetic energy to dry a wet colorant applied to a continuous-form print media by a printer. The waveguide includes a structure with a long axis that extends across a width of the print media, and includes a passageway through the structure to pass the print media through a short axis of the waveguide. The passageway is sized to pass the continuous-form print media through the structure. The microwave dryer also includes a microwave source coupled to the waveguide configured to provide the electromagnetic energy at an operating frequency, and a frequency shift keying (FSK) modulator coupled to the microwave source configured to modulate the operating frequency with a series of discrete frequencies to vary intensity positions to reduce a variation of intensity of the electromagnetic energy in a direction across the width of the print media. The microwave dryer further includes a processor coupled to the FSK modulator configured to determine a period of time for the print media to traverse through the short axis of the waveguide, to determine a modulating signal with a modulating frequency based on the period of time, to determine a number of frequencies that approximate the modulating signal at the modulating frequency, and to apply binary values that represent the number of frequencies to an input of the FSK modulator to cause the FSK modulator to output the series of discrete frequencies over the period of time.

Another embodiment is a method that includes operating a microwave source coupled to a waveguide by generating electromagnetic energy at an operating frequency with the microwave source and transporting the electromagnetic energy with the waveguide to dry a wet colorant applied to a continuous-form print media by a printer. The waveguide includes a structure with a long axis that extends across a width of the print media, and includes a passageway through the structure to pass the print media through a short axis of the waveguide. The passageway is sized to pass the continuous-form print media through the structure. The method also includes determining, with a processor, a period of time for the print media to traverse through the short axis of the waveguide, determining a modulating signal with a modulating frequency based on the period of time, and determining a number of frequencies that approximate the modulating signal at the modulating frequency. The method further includes applying binary values that represent the number of frequencies to an input of a frequency shift keying (FSK) modulator to modulate the operating frequency with a series of discrete frequencies that vary intensity positions to reduce a variation of intensity of the electromagnetic energy in a direction across the width of the print media over the period of time.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DESCRIPTION OF THE EMBODIMENTS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
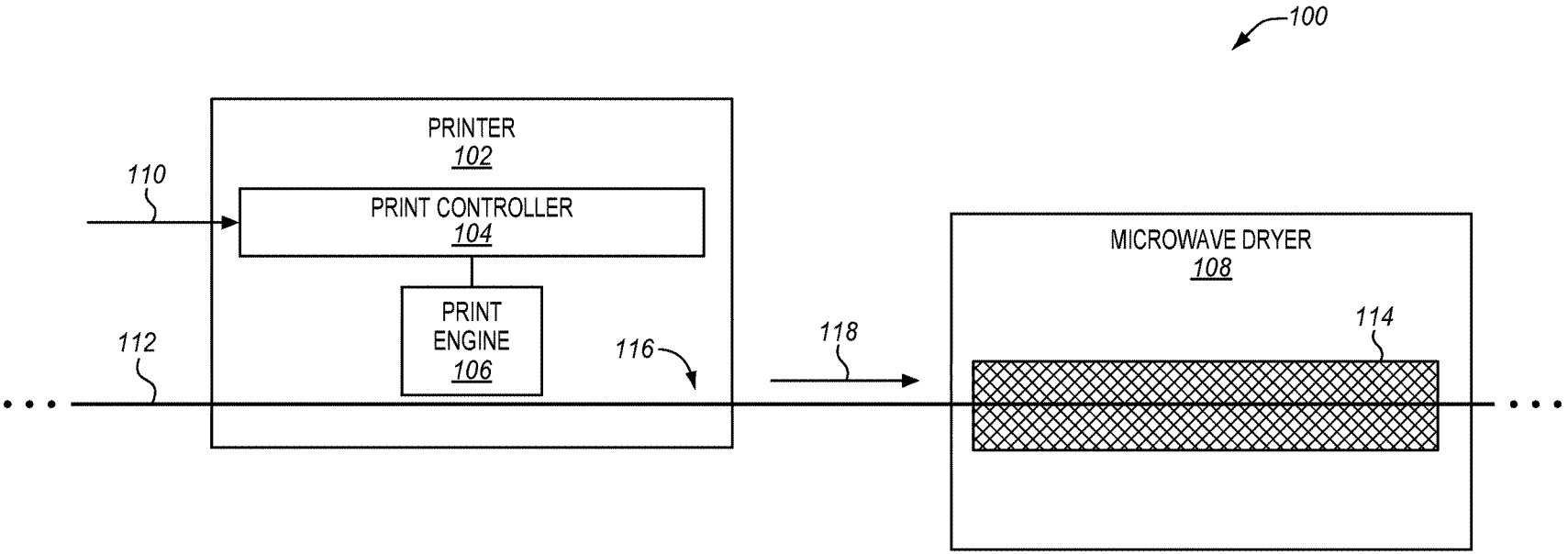
FIG. 1 is a block diagram of a printing system in an exemplary embodiment.

FIG. 1 is a block diagram of a printing system 100 in an exemplary embodiment. Printing system 100 generally includes a printer 102 and a microwave dryer 108. Printer 102 applies a wet liquid or colorant (e.g., aqueous inks, oil-based paints, etc.) to a top surface 116 of print media 112 (e.g., a continuous-form print medium such as paper). In doing so, a print controller 104 of printer 102 receives print data 110 for imprinting onto print media 112, which is rasterized by print controller 104 into bitmap data. The bitmap data is used by a print engine 106 (e.g., a drop-on-demand print engine, a continuous-ejection print engine, etc.) to apply wet colorant to print media 112. After being marked with wet colorant, print media 112 travels in the direction indicated by the arrow along a media path 118 in FIG. 1. Microwave dryer 108 applies electromagnetic energy 114 (e.g., microwave energy) to print media 112 which heats the wet colorants applied to print media 112 to evaporate a liquid portion of the wet colorants, thereby fixing the wet colorants to print media 112. Printer 102, print controller 104, print engine 106 and microwave dryer 108 may be separate devices or incorporated with one another in various embodiments.

Figure 2:
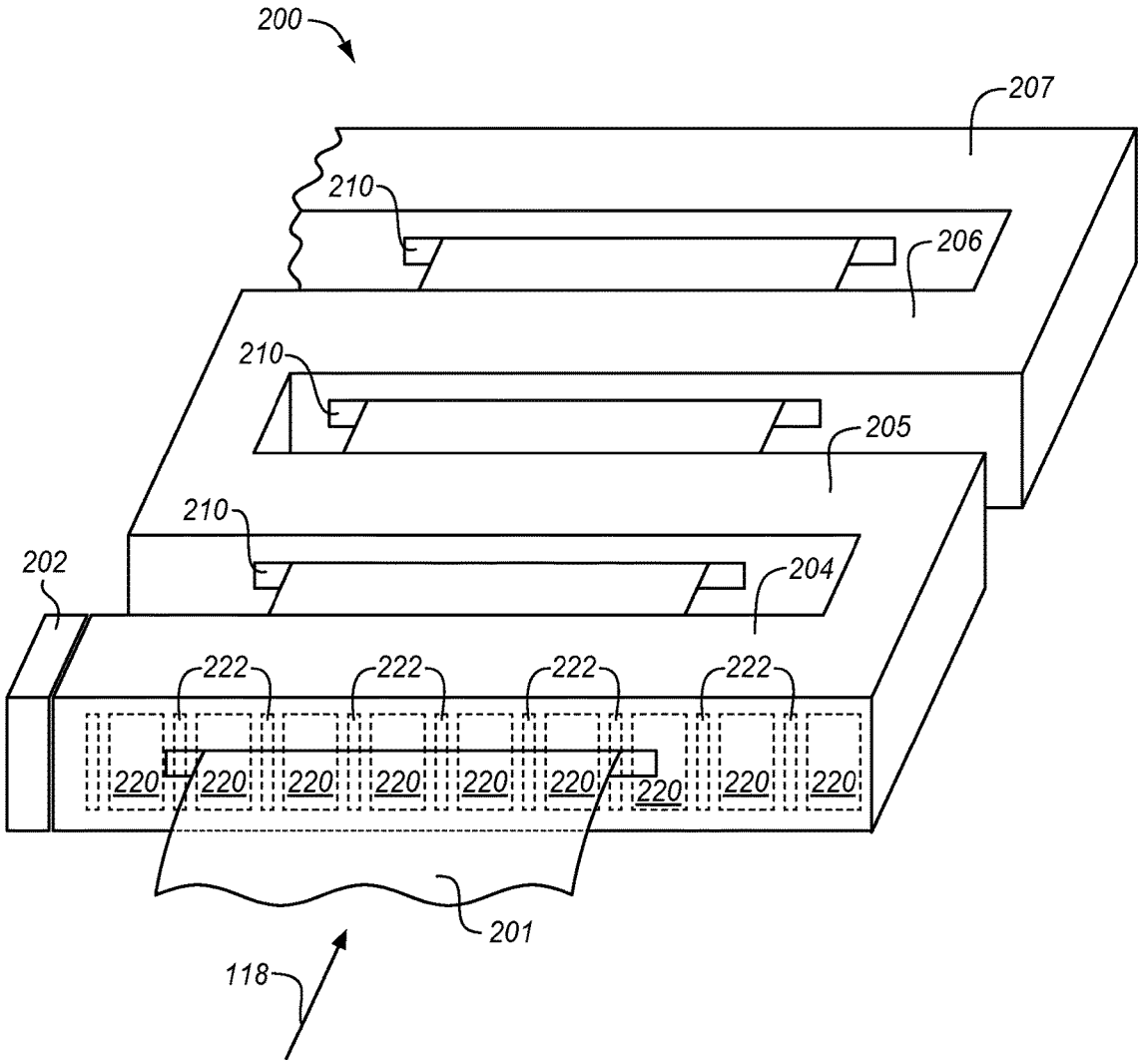
FIG. 2 is a perspective view of a microwave dryer.

FIG. 2 illustrates a perspective view of a microwave dryer 200. Microwave dryer 200 includes a microwave source 202, such as a magnetron, that generates microwaves, and a plurality of microwave waveguides 204-207. Microwave waveguides 204-207 are electromagnetically coupled together in a pattern such that microwave energy injected by microwave source 202 into one end of a waveguide 204 follows a serpentine path (e.g., an "S" pattern) from one end to another end of each of the microwave waveguides 204-207. Coupling of waveguides 204-207 may include electromagnetic bend couplers (e.g. e-bend coupler) with other shapes and dimensions from that shown in the figures which illustrate right angle turn coupling for ease of illustration. Microwaves generated by microwave source 202 travel from left to right in waveguide 204 in FIG. 2, are re-directed to waveguide 205 via the bend coupler, and then travel from right to left in waveguide 205. This back and forth pattern continues for waveguides 206-207, with the microwaves taking a serpentine path through microwave waveguides 204-207.

Microwave waveguides 204-207 each have a long axis that spans across a width of the print media 112 and a passageway 210 (not labeled for waveguide 204 for illustration purposes) that is a path for the print media 112 through a short axis through the microwave waveguides 204-207 that is sized to accept print media 112. The passageway 210 may have a width that is at least as wide as print medium 112 and width less than the length of microwave waveguide 204-207. The microwave waveguide short axis is generally in the direction of the media path 118 (e.g., parallel or substantially parallel to travelling direction of print media 112 and orthogonal to the long axis). Microwave waveguides 204-207 are spaced from one another with successive microwave waveguides 204-207 placed downstream in parallel fashion in the print media 112 direction along media path 118. Since waveguides 204-207 may be hollow, passageway 210 may include two openings at either end of the short axis along the media path 118 in each waveguide 204-207 for passage of print media 112 through each waveguide 204-207 (the vertical height of the openings being shorter than the vertical height of the hollow portion of each waveguide 204-207). For embodiments in which adjacent waveguides 204-207 abut one another, adjacent openings of different passageways 210 may have a common boundary that defines the area for passing print media 112 through adjacent waveguides 204-207. At the last coupled microwave waveguide of 204-207 of microwave dryer 200, a termination element (not shown) (e.g. shorting plate or matched load) is located at the un-coupled end to terminate the microwaves. Termination element produces standing waves in the microwave waveguides 204-207 if it is a shorting plate and produces traveling waves in microwave waveguides 204-207 if it is a matched load.

In FIG. 2, the microwaves are illustrated within waveguide 204 as a standing wave that forms Radio Frequency (RF) peaks with a high concentration of energy that creates high energy areas 220 across the exposed width of the print media 112. In between the high energy areas 220, lower concentrations of RF energy create low energy areas 222 across the width of the print media 112. Wet colorants on print media 112 dry faster when exposed to high energy areas 220 versus low energy areas 222. The result is a series of electromagnetic high energy and low energy spots that vary in position across the exposed width of print media 112 that reduce drying quality and the printed output of printing system 100. The high energy areas 220 and low energy areas 222 shown in waveguide 204 extend through the coupled waveguides 204-207 in a similar manner though they are not shown. In other embodiments, the microwaves in the coupled waveguides 204-207 are traveling waves that produce high energy areas 220 and low energy areas 222 within the waveguides 204-207. Microwave dryer 200 may therefore be enhanced to minimize the high energy and low energy region variation across the width of print media 112 for even heating and drying across print media 112.

Figure 3:
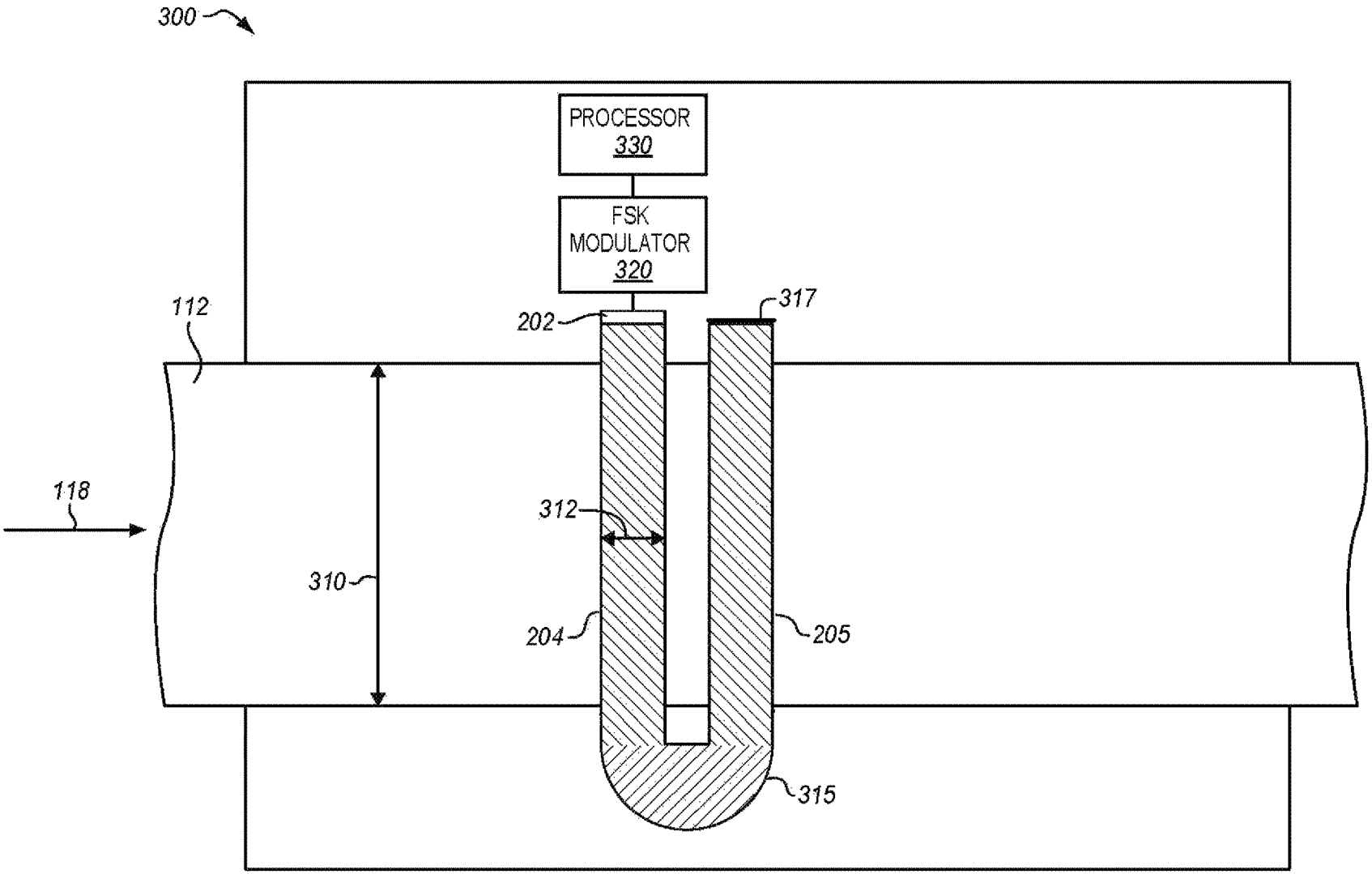
FIG. 3 illustrates a top view of a microwave dryer of a print system with modulation of the microwave source using frequency shift keying (FSK).

FIG. 3 illustrates a top view of microwave dryer 300 of a print system (e.g., printing system 100) with modulation of the microwave source using frequency shift keying (FSK) in an exemplary embodiment. Microwave dryer 300 includes a frequency shift keying (FSK) modulator 320 and a processor 330 that operate in conjunction with microwave source 302 to provide uniform heating across the width 310 of print media 112. Microwave source 302 (e.g., a magnetron) has an input coupling to control the frequency modulation of the operating frequency (e.g., 2.45 GHz, 915 MHz, or another operating frequency). By frequency modulating the operating frequency of microwave source 302, microwave dryer 300 continually repositions the RF peaks along the width 310 of print media 112 to evenly distribute heating and eliminate the pattern of electromagnetic high energy areas 220 and low energy areas 212 described in FIG. 2.

FSK modulator 320 is any system, device, or component operable to couple to microwave source 302 and to modulate the operating frequency of microwave source 302. Processor 330 is any system, device, or component operable to control FSK modulator 320 with a binary input. Suppose, for example, that microwave source 302 operates with an operating frequency of 2.45 GHz to inject microwaves at one end of waveguide 204. The microwaves traverse along a long axis of waveguide 204 across the width 310 of the print media 112 to another end of waveguide 204. Print media 112 traverses crosswise through waveguide 204 via passageway 210 to expose print media 112 for a width 312 of waveguide 204 along media path 118 (e.g., across the short axis of waveguide 204). Accordingly, waveguide 204 may include a passageway 210 (not shown in FIG. 3) having a width slightly larger than the width 310 of print media 112 or media path 118. With FSK modulator 320 and/or processor 330 coupled to microwave source 302, FSK modulator 320 may be applied to microwave source 302 to cause a shift in the operating frequency, thereby distributing the intensity of the electromagnetic energy 114 across the width 310 of print media 112.

In general, microwave dryer 300 implements a form of frequency modulation known as frequency shift keying (FSK). In frequency modulation, a carrier signal is changed by a modulating signal. More particularly, the amplitude of the modulating signal defines how far (in frequency) the carrier signal shifts, and the frequency of the modulating signal determines how quickly the carrier signal shifts from one frequency to another. Unlike analog frequency modulation which requires an infinite number of frequency states, FSK is a digital modulation protocol that changes the frequency of a carrier signal using a discrete number of frequencies and is typically used in communication systems to transmit digital data over an analog signal. One advantage of FSK over analog frequency modulation is that modulation may be achieved with digital components. As described in greater detail below, FSK as implemented by FSK modulator 320 and processor 330 enables microwave dryer 300 to quickly adapt to variables in a print system such as printing system 100.

FSK modulator 320 and/or processor 330 may be implemented as custom, circuitry, one or more Central Processing Unit(s) (CPU), microprocessor(s), Digital Signal Processor(s) (DSP), Application-specific Integrated Circuit(s) (ASIC), etc. Although FIG. 3 shows two coupled microwave waveguides 204-205, any number of coupled microwave waveguides may be utilized as a matter of design choice to achieve a desired level of performance for drying wet colorants applied to print media 112 by printer 102. Furthermore, electromagnetic energy 114 generated by microwave source 302 may travel from the end of one microwave waveguide to the beginning of another waveguide via bend coupler 315 (e.g. E-bend coupler) shown in FIG. 3. The last waveguide in a row of waveguides may include a termination element 317 (e.g. shorting plate or matched load) located at the uncoupled end to terminate microwaves. Microwave waveguides 204-205, bend coupler and termination element 317 designs are chosen based on the operating frequencies.

Figure 4:
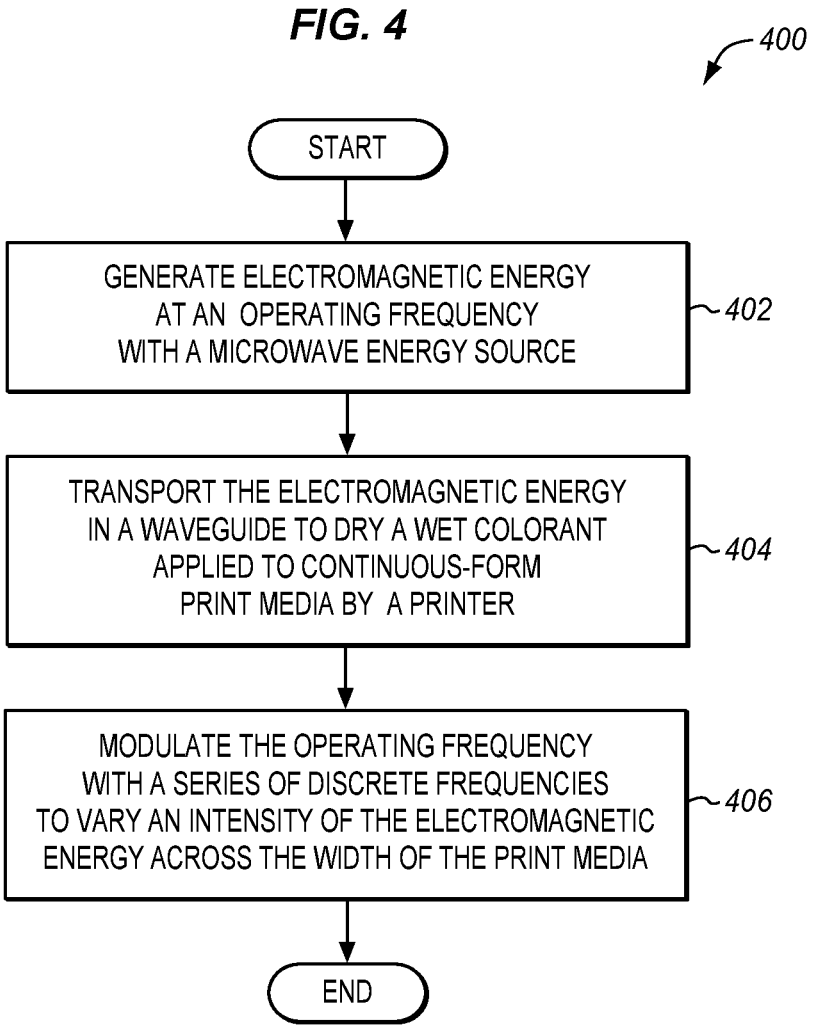
FIG. 4 is a flow chart of a method of operating a microwave dryer in an exemplary embodiment.

FIG. 4 is a flow chart of a method 400 of operating microwave dryer 300 in an exemplary embodiment. Though discussed with respect to printing system 100 of FIG. 1 and microwave dryer 300 of FIG. 3, method 400 may apply to other systems. The steps of method 400 are not inclusive, may include additional or alternative steps, and may be performed in an alternate order.

In step 402, microwave source 302 generates electromagnetic energy 114 at an operating frequency (e.g., 2.45 GHz). As earlier described, microwave source 302 may be coupled with waveguide 204 to provide electromagnetic energy 114 to a substantially confined channel defined by the walls of waveguide 204. In step 404, waveguide 204 transports the electromagnetic energy 114 to dry a wet colorant applied to a continuous-form print media 112 by a printer (e.g., printer 102). In that regard, waveguide 204 may include a structure with a long axis that extends across a width of the print media, and may further include a passageway in the structure to allow passage of print media 112 traveling along a media path in microwave dryer 300.

In step 406, FSK modulator 320 modulates the operating frequency of the microwave source 302 with a series of discrete frequencies to vary intensity positions of the electromagnetic energy 114 across the width of the print media 112. That is, the physical locations of peaks and nulls of the electromagnetic energy 114 vary in a direction across the width of the print media 112. By modulating the frequency with a series of discrete frequencies, drying performance of microwave dryer 300 is improved over other microwave dryers and may be implemented with relatively simple electrical components capable of producing binary input to control FSK modulator 320.

Figure 5:
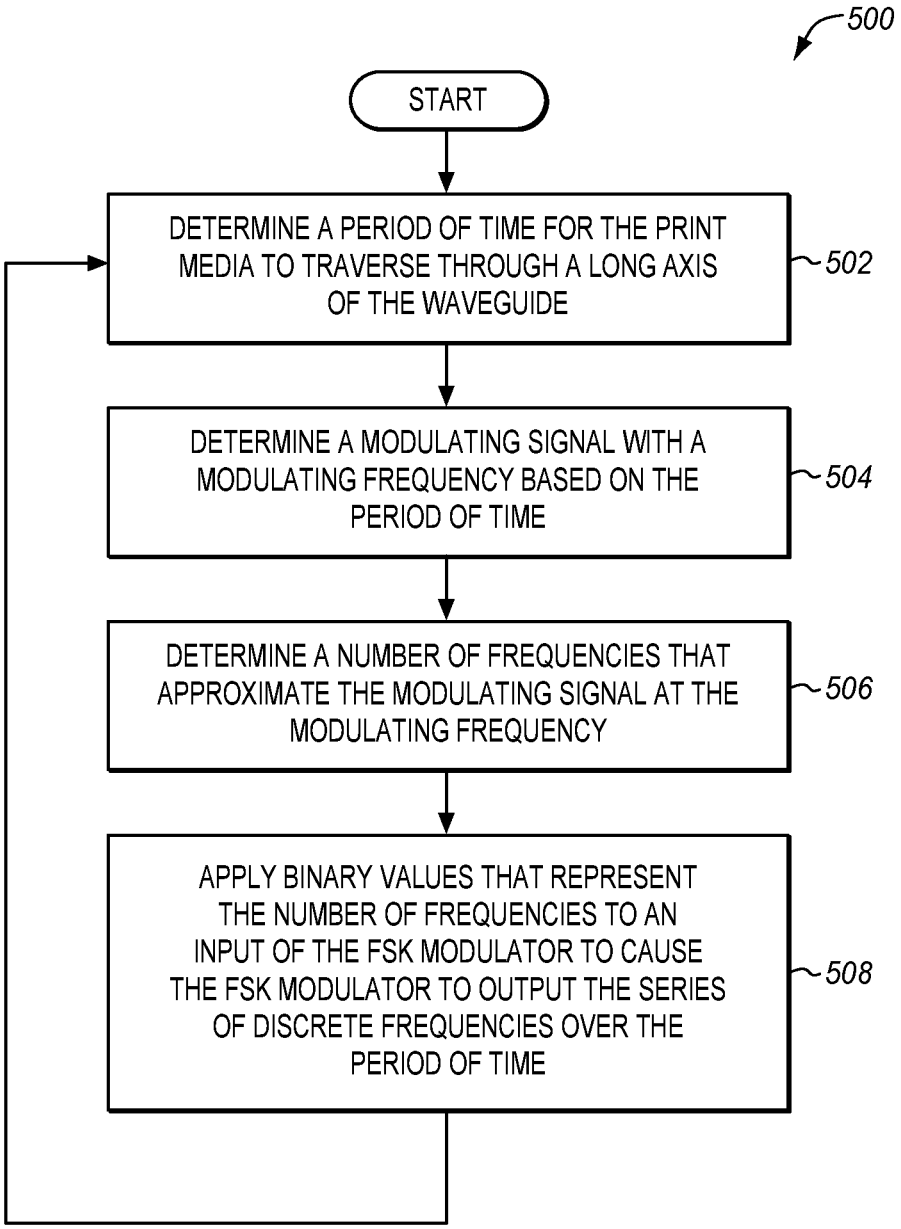
FIG. 5 is a flow chart of a method of modulating a microwave energy source of a microwave dryer with a series of discrete frequencies in an exemplary embodiment.

FIG. 5 is a flow chart of a method 500 of modulating a microwave source 302 of a microwave dryer 300 with a series of discrete frequencies applied over a period of time in an exemplary embodiment. Though discussed with respect to printing system 100 of FIG. 1 and microwave dryer 300 of FIG. 3, method 500 may apply to other systems. The steps of method 500 are not inclusive, may include additional or alternative steps, and may be performed in an alternate order.

In step 502, processor 330 determines a period of time for print media 112 to traverse through a passageway 210 through width 312 through the short axis of waveguide 204. The period of time is an amount of time that any given point on print media 112 is within the confines of waveguide 204 as print media 112 travels along media path 118. The period of time is thus a function of travel speed of print media 112 and the width 312 of waveguide 204 along media path 118. Values for the width 312 of waveguide 204 and speed of print media 112 may be retrieved from memory. For instance, processor 330 may access memory that stores an association of speed of print media 112 with particular operating/drying modes of microwave dryer 300, print job types, print media 112 types, etc. Alternatively or additionally, processor 330 may retrieve values for the speed of print media 112 in microwave dryer 300 from a sensor, user input via a graphical user interface, print controller 104 of printer 102, etc. As described in greater detail below, the period of time determined in step 502 may be used for modulating with FSK modulator 320 (e.g., described above in step 406).

In step 504, processor 330 determines a modulating signal with a modulating frequency based on the period of time. Since the modulating frequency defines how quickly the operating frequency shifts, processor 330 may use the period of time determined in step 502 (e.g., the exposure time of print media 112 in waveguide 204) to calculate an optimal rate, or number of frequency shifts per second to perform, such that a full spectrum of frequencies transmitted by microwave source 302 occurs during the exposure time of print media 112 in waveguide 204. That is, the operating frequency of microwave source 302 is to be modulated a frequency deviation amount within the time that it takes print media 112 to travel through the width 312 of waveguide 204 along media path 118.

In step 506, processor 330 determines a number of frequencies that approximate the modulating signal at the modulating frequency. With the modulating frequency determined in step 504, processor 330 may calculate a minimum number of discrete levels to which the modulating signal may be quantized to sufficiently vary the operating frequency to the desired accuracy. Alternatively or additionally, processor 330 may access memory that stores an association of a number of discrete frequencies for various values of modulating frequencies. Processor 330 may also determine a frequency value for each of the discrete frequencies based at least in part on a desired frequency deviation amount. For example, for a microwave source that operates at 2.45 GHz, it may be desirable to deviate the operating frequency+/−10 MHz so that it oscillates between 2.46 GHz and 2.44 GHz. However, alternative frequency deviation amounts may be implemented between a minimum value that is able to provide a desired uniformity of the electrical field within waveguide 204 and a maximum value which does not exceed a cost of technology components which are able to implement rapid modulation/variation of the operating frequency.

In step 508, processor 330 applies binary values that represent the number of frequencies to an input of FSK modulator 320 to cause FSK modulator 320 to output the series of discrete frequencies over the period of time. Since each discrete frequency may be represented by a combination of bits, processor 330 may convert a value of each discrete frequency (e.g., determined in step 506) into a binary format that is compatible with a desired output at FSK modulator 320. Processor 330 may also determine/calculate a constant or varying transmit period for each of the binary values based on the period of time and the number of frequencies. In one embodiment, the transmit period may be determined based by dividing the time period from step 502 by the number of frequencies from step 506 yielding a constant value. In other embodiments the transmit period may be variable to facilitate drying of certain regions of the print media 112. Since the amplitude of the modulating signal defines a deviation amount in the operating frequency, the amplitude of the modulating signal (and thus the deviation amounts in the operating frequency of microwave source 302) may fluctuate across consecutively transmitted discrete frequencies while the transmit period for consecutively transmitted discrete frequencies is constant.

By using FSK modulation according to method 500 described above, microwave dryer 300 may implement a customizable amount of sweep in the operating frequency of microwave source 302. The deviation amount and rate of change in the operating frequency may be adapted to various print/drying considerations, such as the speed of print media 112, type of print media 112, amounts of ink applied to print media by print controller 104, type of print job or print data 110, etc. Additional examples and points of illustration are described below.

Figure 6:
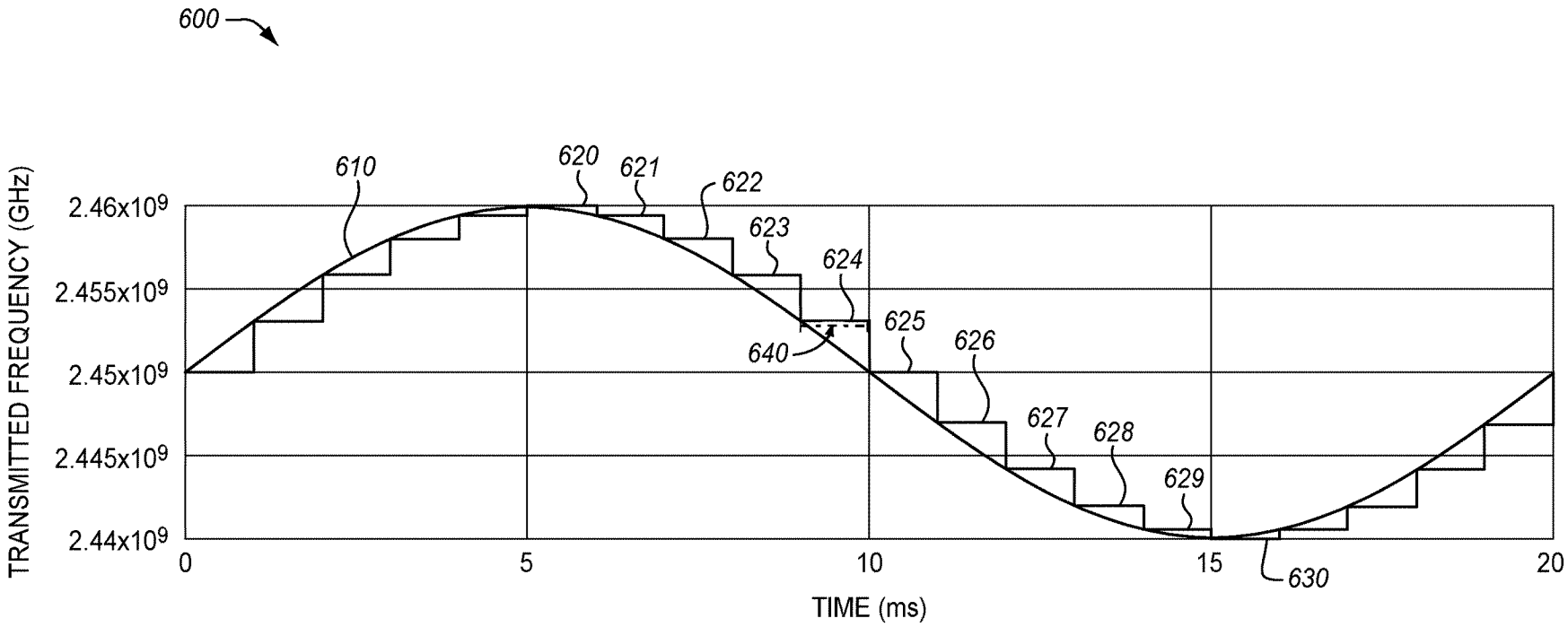
FIG. 6 illustrates a plot of a modulating signal in an exemplary embodiment.

FIG. 6 illustrates a plot of a modulating signal in an exemplary embodiment. Assume, for this example, that microwave source 302 operates at 2.45 GHz, and that print media 112 has a travel speed through microwave dryer of 150 meters/minute and width 312 of microwave waveguide 204 is 4.3 cm. From this, processor 330 may determine that print media 112 has an exposure time of 17.2 milliseconds traversing through each microwave waveguide 204. Processor 330 may then select a modulating frequency that is capable of supporting a full spectrum of frequency shifts within 17.2 milliseconds. In this example, the modulating signal 610 has a frequency of 50 Hz and a period of 0.02 seconds, or 20 milliseconds, and thus can support a full spectrum of frequency shifts within 17.2 milliseconds. Processor 330 therefore determines to use a modulating signal 610 with a modulating frequency of 50 Hz.

Further assume for this example that a frequency deviation of +/−10 MHz for microwave source 302 is desired. Thus, the 50 Hz modulating signal 610 is to swing microwave source 302 between 2.46 GHz and 2.44 GHz about its center operating frequency of 2.45 GHz, as shown in plot 600. From this, processor 330 may quantize the modulating signal 610 into a series of discrete frequencies 620-630 to approximate the modulating signal 610 in binary form. In the process of converting the modulating signal 610 into a series of discrete frequencies 620-630, processor 330 may determine that eleven unique frequencies is the minimum number of discrete frequencies 620-630 to sufficiently approximate modulating signal 610 (and to sufficiently vary microwave source 302). Each discrete frequency is represented by a combination of bits (e.g., 4 bits to control FSK modulator 320 to output sixteen possible different frequencies, but in this case using just eleven of sixteen binary combinations) that indicate an amplitude value (which defines an amount of shift in operating frequency) and processor 330 may set the rate of shifts in the operating frequency by controlling FSK modulator 320 transmit discrete frequencies 620-621 in discrete intervals as shown in plot 600. That is, processor 330 may calculate a transmit period (i.e. transmission duration) of 1 millisecond for each of the binary values such that a full spectrum of the eleven unique discrete frequencies 620-630 (e.g., defined by a half period of modulating signal 610) may occur within the exposure time of 17.2 milliseconds. As shown in plot 600, processor 330 may transmit the discrete frequencies 620-630 to FSK modulator 320 (and/or cause FSK modulator 320 to transmit/apply discrete frequencies 620-630 to microwave source 302) in even or varying transmit periods (i.e. bit durations) and uneven amplitudes.

Figure 7:
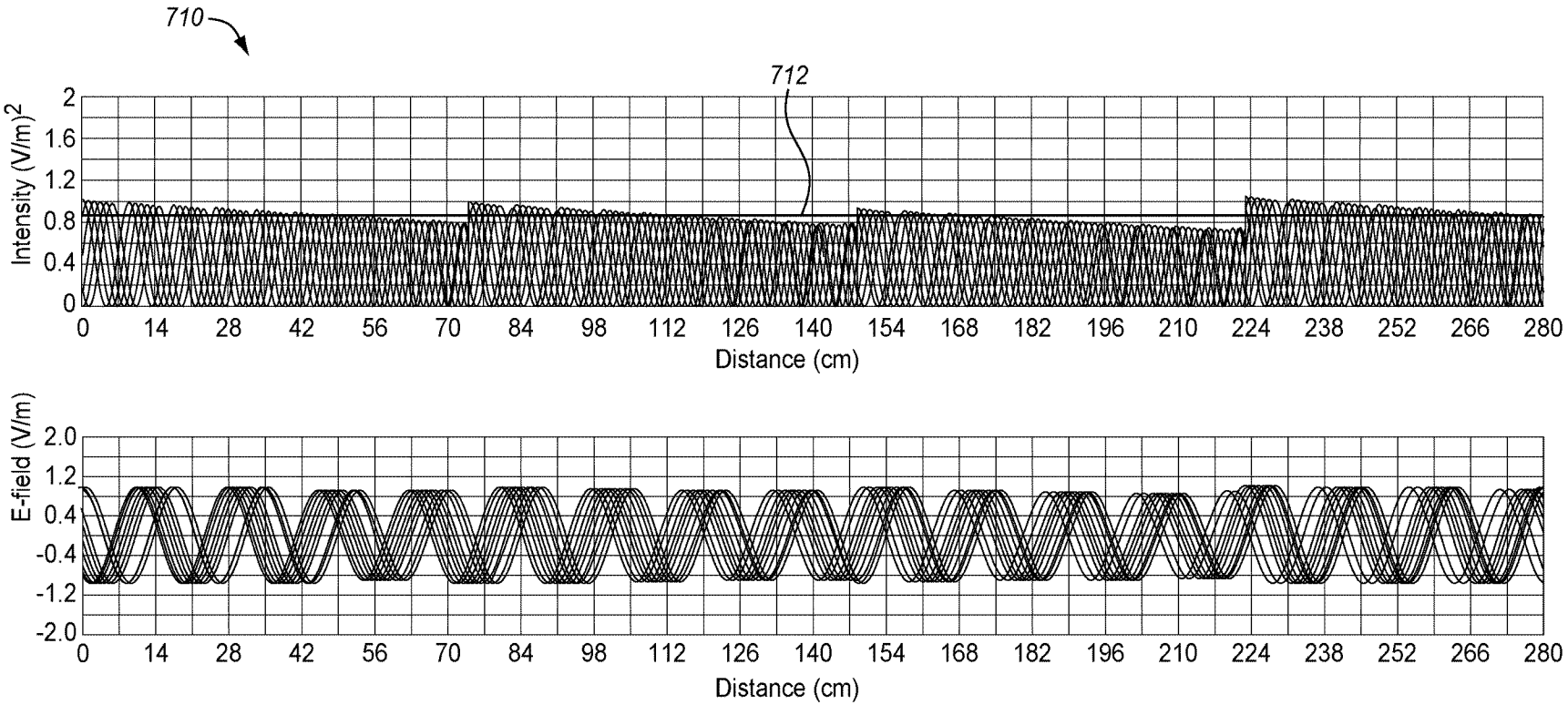
FIG. 7 illustrates an intensity plot and a field strength plot according to an FSK modulation of microwave source using eleven discrete frequencies in an exemplary embodiment.

FIG. 7 illustrates an intensity plot 710 and a field strength plot 720 according to an FSK modulation of microwave source 302 using eleven discrete frequencies in an exemplary embodiment. In continuing with the example described above with respect to FIG. 6, the application of eleven discrete frequencies 620-621 to modulate microwave source 302 results in reduced variation in (i.e., a relatively constant) intensity 712 (expressed as power per unit area or (V/m) squared) along the long axis of waveguide 204 (and continuing along the long axis of any additional waveguides coupled thereto) thereby providing uniform heating across the width 310 of print media 112 or media path 118. Similarly, the e-field strength plot 720 (expressed as volts per meter) shows an even distribution down the length of several waveguides (e.g., each waveguide approximately 70 cm in length).

Figure 8:
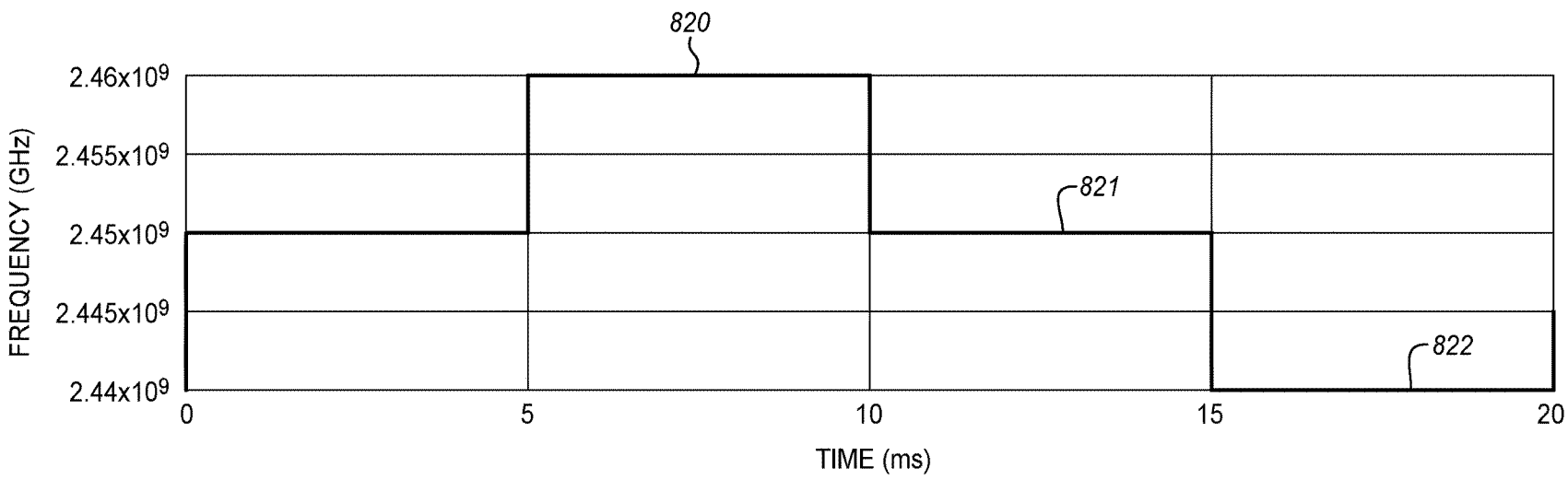
FIG. 8 illustrates a plot of a modulating signal approximated with three unique frequencies in an exemplary embodiment.

FIG. 8 illustrates a plot of a modulating signal approximated with three unique frequencies in an exemplary embodiment. Suppose that all exemplary values described with respect to FIG. 6 remain the same except the number of frequencies to represent the modulating signal 610 is three instead of eleven. Here, fewer bits may be used to control FSK modulator 320 (e.g., 2 bits to control FSK modulator 320 to output four possible different frequencies) and each bit or discrete frequency transmission period is longer compared with the eleven unique frequency example described above. However, the resulting frequency sweep of microwave source 302 may produce an insufficient distribution of the operating frequency in waveguide 204 depending on the particular desired parameters of microwave dryer 300. Therefore, processor 330 may determine a number of discrete frequencies to use that minimizes the operating resources of processor 330, FSK modulator 320, and/or components thereof (e.g., according to processing speeds, capacity, etc.) while still performing a threshold number of frequency shifts to sufficiently vary microwave source 302 output microwaves.

Figure 9:
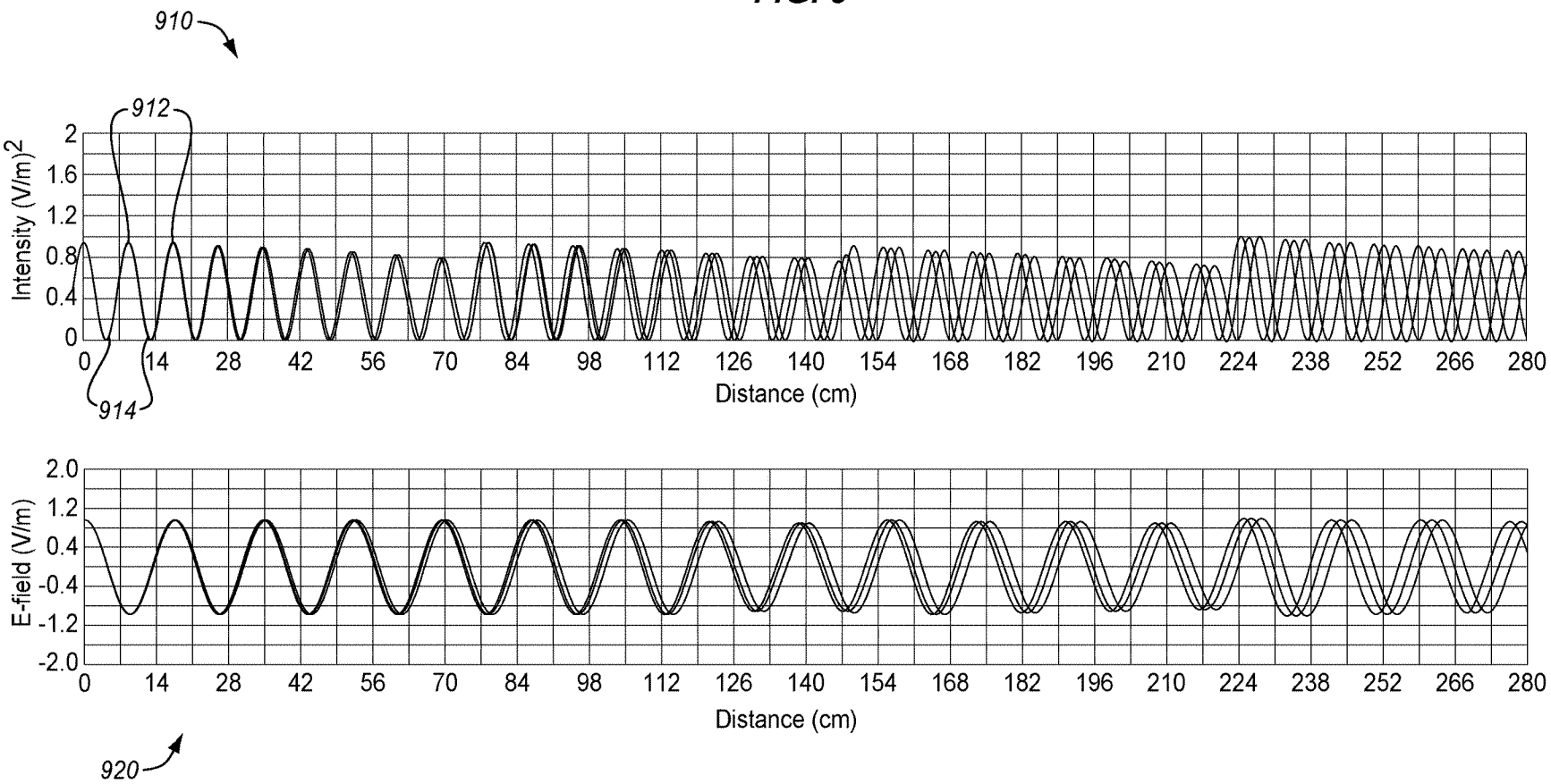
FIG. 9 illustrates an intensity plot and a field strength plot according to an FSK modulation of microwave source using three discrete frequencies in an exemplary embodiment.

FIG. 9 illustrates an intensity plot 910 and a field strength plot 920 according to an FSK modulation of microwave source 302 using three discrete frequencies in an exemplary embodiment. As shown in intensity plot 910, the use of three discrete frequencies to modulate the 2.45 GHz operating frequency of microwave source 302 as compared with the eleven discrete frequencies results relatively large distances between intensity peaks along the long axis of waveguide 204 (and continuing along the long axis of any additional waveguides coupled thereto), resulting in a pattern of high energy areas 912 and low energy areas 914 spaced along waveguide 204 and across the width of print medium 112. Similarly, the field strength plot 920 shows that the long axis of waveguide 204 has a relatively uneven distribution in comparison with FIG. 7. Thus, the fewer number of discrete frequencies used may produce a lower than desired drying performance in microwave dryer 300.

Figure 10:
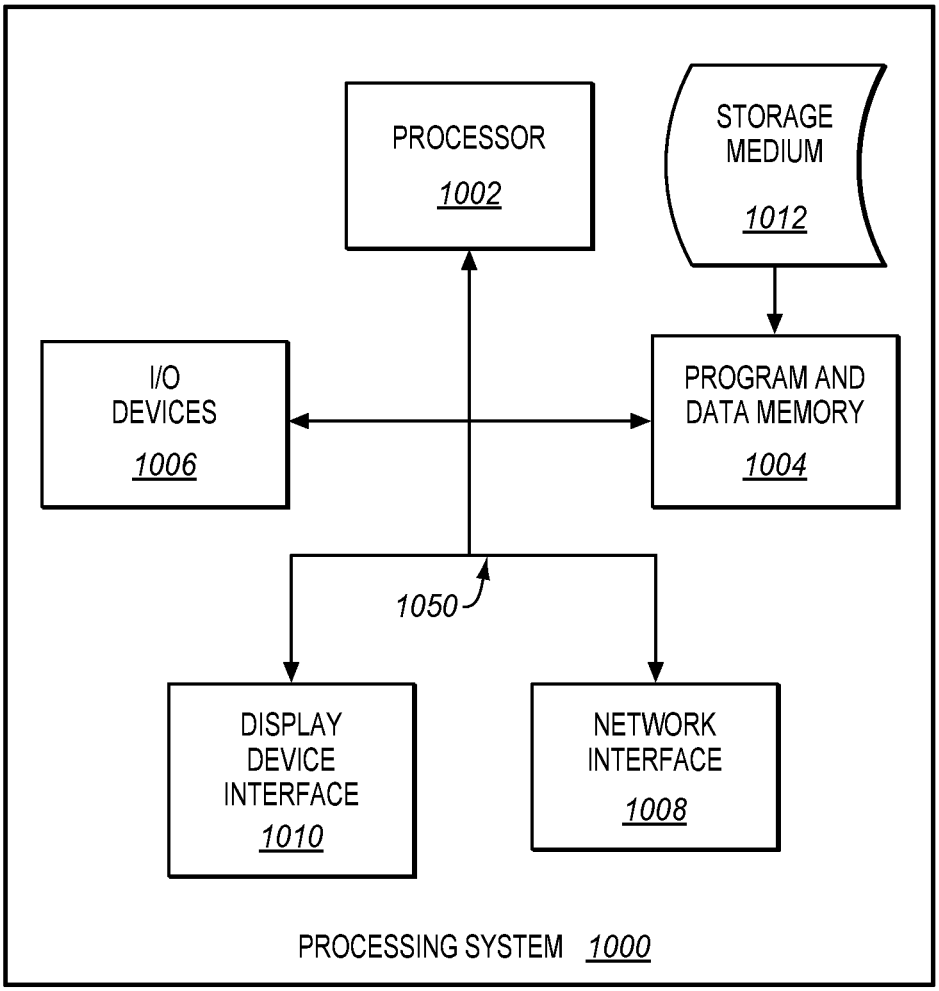
FIG. 10 illustrates a processing system operable to execute a computer readable medium embodying programmed instructions to perform desired functions in an exemplary embodiment.

Embodiments disclosed herein can take the form of software, hardware, firmware, or various combinations thereof. In one particular embodiment, software is used to direct a processing system of microwave dryer 300 to perform the various operations disclosed herein. FIG. 10 illustrates a processing system 1000 operable to execute a computer readable medium embodying programmed instructions to perform desired functions in an exemplary embodiment. Processing system 1000 is operable to perform the above operations by executing programmed instructions tangibly embodied on computer readable storage medium 1012. In this regard, embodiments of the invention can take the form of a computer program accessible via computer-readable medium 1012 providing program code for use by a computer or any other instruction execution system. For the purposes of this description, computer readable storage medium 1012 can be anything that can contain or store the program for use by the computer.

Computer readable storage medium 1012 can be an electronic, magnetic, optical, electromagnetic, infrared, or semiconductor device. Examples of computer readable storage medium 1012 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 1000, being suitable for storing and/or executing the program code, includes at least one processor 1002 coupled to program and data memory 1004 through a system bus 1050. Program and data memory 1004 can include local memory employed during actual execution of the program code, bulk storage, and cache memories that provide temporary storage of at least some program code and/or data in order to reduce the number of times the code and/or data are retrieved from bulk storage during execution. Some examples of processors include Intel® Core™ processors, Advanced Reduced Instruction Set Computing (RISC) Machines (ARM®) processors, etc. Memory may additionally or alternatively include any hardware device that is able to store data, such as one or more volatile or non-volatile Dynamic Random Access Memory (DRAM) devices, FLASH devices, volatile or non-volatile Static RAM devices, hard drives, Solid State Disks (SSDs), etc. Some examples of non-volatile DRAM and SRAM include battery-backed DRAM and battery-backed SRAM.

Input/output or I/O devices 1006 (including but not limited to keyboards, displays, pointing devices, etc.) can be coupled either directly or through intervening I/O controllers. Network adapter interfaces 1008 may also be integrated with the system to enable processing system 1000 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 1010 may be integrated with the system to interface to one or more display devices, such as printing systems and screens for presentation of data generated by processor 1002.

Although specific embodiments were described herein, the scope of the invention is not limited to those specific embodiments. The scope of the invention is defined by the following claims and any equivalents thereof.

What is claimed is:

1. A microwave dryer comprising:

a waveguide configured to transport electromagnetic energy to dry a wet colorant applied to a continuous-form print media by a printer, wherein the waveguide includes a structure with a long axis that extends across a width of the print media, and includes a passageway through the structure to pass the print media through a short axis of the waveguide, wherein the passageway is sized to pass the continuous-form print media through the structure;

a microwave source coupled to the waveguide configured to provide the electromagnetic energy at an operating frequency;

a frequency shift keying (FSK) modulator coupled to the microwave source configured to modulate the operating frequency with a series of discrete frequencies to vary intensity positions of the electromagnetic energy to reduce a variation of intensity in a direction across the width of the print media; and a processor coupled to the FSK modulator configured to determine a period of time for the print media to traverse through the passageway of the waveguide, to determine a modulating signal with a modulating frequency based on the period of time, to determine a number of frequencies that approximate the modulating signal at the modulating frequency, and to apply binary values that represent the number of frequencies to an input of the FSK modulator to cause the FSK modulator to output the series of discrete frequencies over the period of time.

2. The microwave dryer of claim 1, wherein:

the processor is configured to determine a transmit period for each of the binary values based on the period of time and the number of frequencies.

3. The microwave dryer of claim 2, wherein:

the number of frequencies that approximate the modulating signal includes at least eleven discrete frequencies to vary intensity positions of the electromagnetic energy in the direction across the width of the print media; and the transmit period for each of the binary values is one millisecond or less.

4. The microwave dryer of claim 3, wherein:

the operating frequency of the microwave source is 2.45 GHz.

5. The microwave dryer of claim 4, wherein:

the processor is configured to determine the modulating signal based on a 10 MHz deviation to the 2.45 GHz operating frequency.

6. The microwave dryer of claim 4, wherein:

the transmit period for each of the binary values is constant.

7. The microwave dryer of claim 1, wherein:

the processor is configured to determine the period of time for the print media to traverse the passageway of the waveguide based on a speed of the print media.

8. The microwave dryer of claim 1, further comprising:

another waveguide coupled to the waveguide that is parallel with the waveguide and spaced downstream from the waveguide in a direction of travel of the print media; and a bend coupler that electromagnetically couples an end the waveguide and an end of the another waveguide.

9. A method comprising:

operating a microwave source coupled to a waveguide by generating electromagnetic energy at an operating frequency with the microwave source and transporting the electromagnetic energy with the waveguide to dry a wet colorant applied to a continuous-form print media by a printer, wherein the waveguide includes a structure with a long axis that extends across a width of the print media, and includes a passageway through the structure to pass the print media through a short axis of the waveguide, wherein the passageway is sized to pass the continuous-form print media through the structure;

determining, with a processor, a period of time for the print media to traverse through the short axis of the waveguide;

determining a modulating signal with a modulating frequency based on the period of time;

determining a number of frequencies that approximate the modulating signal at the modulating frequency; and applying binary values that represent the number of frequencies to an input of a frequency shift keying (FSK) modulator to modulate the operating frequency with a series of discrete frequencies that vary intensity positions to reduce a variation of intensity of the electromagnetic energy in a direction across the width of the print media over the period of time.

10. The method of claim 9, further comprising:

determining a transmit period for each of the binary values based on the period of time and the number of frequencies.

11. The method of claim 10, wherein:

the number of frequencies that approximate the modulating signal includes at least eleven discrete frequencies to vary intensity positions of the electromagnetic energy in the direction across the width of the print media; and the transmit period for each of the binary values is one millisecond or less.

12. The method of claim 11, wherein:

the operating frequency of the microwave source is 2.45 GHz.

13. The method of claim 12, further comprising:

determining the modulating signal based on a 10 MHz deviation to the 2.45 GHz operating frequency.

14. The method of claim 12, wherein:

the transmit period for each of the binary values is constant.

15. The method of claim 9, further comprising:

determining the period of time for the print media to traverse the passageway of the waveguide based on a speed of the print media.

16. A non-transitory computer readable medium embodying programmed instructions which, when executed by a processor, are operable for performing a method for operating a microwave dryer that includes a microwave source coupled to a waveguide, the microwave source operable to generate electromagnetic energy at an operating frequency, and the waveguide operable to transport the electromagnetic energy with the waveguide to dry a wet colorant applied to a continuous-form print media by a printer, wherein the waveguide includes a structure with a long axis that extends across a width of the print media, and includes a passageway through the structure to pass the print media through a short axis of the waveguide, wherein the passageway is sized to pass the continuous-form print media through the structure, the method comprising:

determining, with a processor, a period of time for the print media to traverse through the short axis of the waveguide;

determining a modulating signal with a modulating frequency based on the period of time;

determining a number of frequencies that approximate the modulating signal at the modulating frequency; and applying binary values that represent the number of frequencies to an input of a frequency shift keying (FSK) modulator to modulate the operating frequency with a series of discrete frequencies that vary intensity positions to reduce a variation of intensity of the electromagnetic energy in a direction across the width of the print media over the period of time.

17. The medium of claim 16 wherein the method further comprises:

determining a transmit period for each of the binary values based on the period of time and the number of frequencies.

18. The medium of claim 17 wherein:

the number of frequencies that approximate the modulating signal includes at least eleven discrete frequencies to vary intensity positions of the electromagnetic energy in the direction across the width of the print media; and the transmit period for each of the binary values is one millisecond or less.

19. The medium of claim 16 wherein:

the operating frequency of the microwave source is 2.45 GHz.

20. The medium of claim 16 wherein the method further comprises:

determining the period of time for the print media to traverse the passageway of the waveguide based on a speed of the print media.

* * * * *